United States Patent [19]

Hasselbach et al.

[11] 4,230,907

[45] Oct. 28, 1980

[54] DYNAMIC LOUDSPEAKER ABLE TO BE DRIVEN AT INCREASED STEADY POWER

[75] Inventors: Wolfgang Hasselbach, Königstein; Manfred Leyerzapf, Frankfurt am Main; Klaus Dotter, Frankfurt-Bonames; Karleugen Habfast, Schwalbach; Karl Müller, Frankfurt, all of Fed. Rep. of Germany

[73] Assignee: Braun Aktiengesellschaft, Frankfurt am Main, Fed. Rep. of Germany

[21] Appl. No.: 946,834

[22] Filed: Sep. 27, 1978

Related U.S. Application Data

[63] Continuation of Ser. No. 771,798, Mar. 2, 1977, Pat. No. 4,138,593.

[51] Int. Cl.[3] ..... H04R 1/02

[52] U.S. Cl. ..... 179/1 E; 179/115.5 R

[58] Field of Search ..... 179/1 E, 115.5 R

[56] References Cited

U.S. PATENT DOCUMENTS

| | | | |
|---|---|---|---|
| 2,217,177 | 10/1940 | Massa | 179/115.5 R |
| 3,731,760 | 5/1973 | Hammes | 181/199 |
| 3,991,286 | 11/1976 | Henricksen | 179/115.5 H |
| 4,029,910 | 6/1977 | Allison | 179/115.5 ME |

FOREIGN PATENT DOCUMENTS

| | | | |
|---|---|---|---|
| 732959 | 2/1943 | Fed. Rep. of Germany | 179/115.5 R |
| 2605613 | 9/1976 | Fed. Rep. of Germany | 179/115.5 R |
| 2000287 | 9/1969 | France | 335/231 |
| 1348535 | 3/1974 | United Kingdom | 179/1 E |

*Primary Examiner*—James W. Moffitt

*Attorney, Agent, or Firm*—Michael J. Striker

[57] ABSTRACT

The dynamic loudspeaker is comprised of a speaker housing and a front sound panel. A diaphragm is mounted at the front of the speaker. A moving-coil unit is mounted in the speaker and includes a moving coil coupled to the diaphragm for transmitting oscillatory motion thereto. The moving-coil unit when in operation generates heat to such an extent as to tend to limit the rated steady power at which the loudspeaker can be operated without damage to the moving-coil unit. This limiting tendency is counteracted according to the invention by improving the dissipation of the heat generated by the moving-coil unit. The speaker housing or a surface portion thereof and/or the speaker sound panel or sound wall or a surface portion thereof is comprised of a material having a thermal conductivity W equal to or greater than 40 kcal/m-h-°C. A heat-transmitting structure is comprised of a material likewise having a thermal conductivity W equal to or greater than 40 kcal/m-h-°C., and it extends from the moving-coil unit to at least one of the aforementioned portions of the housing and/or sound wall, and is in thermally conductive engagement with both the latter and the moving-coil unit.

4 Claims, 5 Drawing Figures

DYNAMIC LOUDSPEAKER ABLE TO BE DRIVEN AT INCREASED STEADY POWER

This is a continuation, of application Ser. No. 771,798, filed Mar. 2, 1977 now U.S. Pat. No. 4,138,593.

BACKGROUND OF THE INVENTION

The invention relates to dynamic loudspeakers and in particular to the problem of increasing the rated steady power at which they can be driven.

The performance of loudspeakers can be numerically described by a variety of measurable characteristics. Besides magnetic characteristics, the ones most often considered are the peak power at which the speaker can be driven, the natural resonant frequency of the speaker, the frequency range of the speaker, the operating power of the speaker, the sensitivity of the speaker, the frequency-dependence of the gain and phase of the speaker, and the nominal steady power at which the speaker can be driven. The latter signifies the input power at which the speaker can be steadily driven without undergoing permanent damage.

With dynamic loudspeakers, the nominal steady power at which the speaker can be driven is limited by a number of factors, including the heat generated by the moving-coil unit of the speaker during operation. For this reason, high-powered moving-coil units are often comprised of moving coils wound on aluminum coil carriers and fabricated using highly-temperature resistant cement or glue. The moving coil principally transmit the heat which it generates to the central pole core and outer pole plates of the permanent magnet structure of the moving-coil unit, resulting in a heating-up of the entire magnet system. Contributing to this heat build-up is the fact that the magnet system of the moving-coil unit, for acoustical reasons, is often surrounded with mineral wool having heat-insulating characteristics. In some speakers, use is made of spider structures made of aluminum, a material of high thermal conductivity. However, the aluminum spider structures do not establish a heat-dissipating action. Typically, they are comprised of narrow radial arms leading to the front side of the speaker housing, with little or no transmission of heat from these spider arms to the housing. Most often, the ends of the spider arms are mounted on the spider housing by means of resilient material of extremely low thermal conductivity.

SUMMARY OF THE INVENTION

It is a general object of the invention to increase the nominal steady power at which such a speaker can be driven, by dissipating in a novel and highly effective manner the heat generated by the moving-coil unit of the speaker.

According to one advantageous concept of the invention, this is achieved by making the speaker housing, or a part thereof, or one or more parts of the surface thereof, and/or the speaker sound panel or sound wall, or a part thereof, or one or more parts of the surface thereof, of a material having a thermal conductivity W equal to or greater than 40 kcal/m-h-°C. There is then provided a heat-transmitting structure which is comprised of a material likewise having a thermal conductivity W equal to or greater than 40 kcal/m-h-°C. The heat-transmitting structure extends from the moving coil unit to one or more of the aforementioned high-thermal-conductivity parts of the speaker housing or sound wall, and is in thermally conductive engagement with both the moving coil unit and such one or more high-thermal-conductivity parts.

The improved dissipation of the heat generated by the moving-coil unit of the speaker increases considerably the steady power at which the speaker can be driven without undergoing permanent damage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
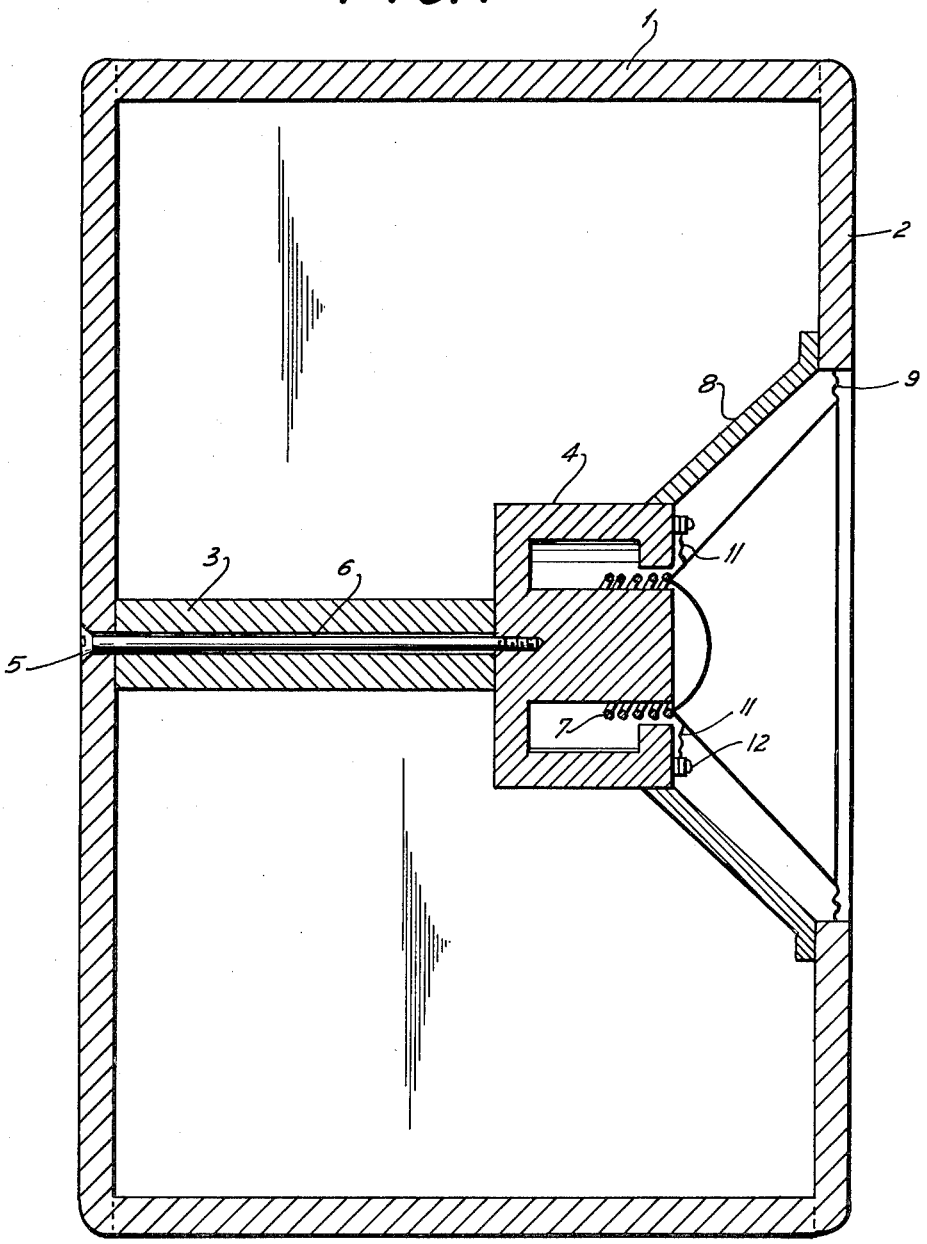
FIGS. 1–5 depict five different embodiments of the present invention.

In FIG. 1, numeral 1 denotes the loudspeaker housing, here made of a material having a thermal conductivity W equal to or greater than 40 kcal/m-h-°C., where kcal=kilocalories, m=meters, h=hours, and °C.=degree celsius. One example of such material is aluminum. The speaker is provided on its front side with a sound panel 2, which can be considered part of the speaker housing or a separate part, and which may or may not be integral therewith. In FIG. 1, the sound wall has the form of such a flat sound panel 2, but other configurations and shapes could likewise be utilized. An aluminum bar 3 has its left end in thermally conductive engagement with the back wall of the speaker housing 1, and has its right end in thermally conductive engagement with the rear face of the permanent magnet structure 4 of the moving-coil unit of the speaker. The aluminum bar 3 is connected to the back wall of the housing and to the permanent magnet structure by means of a long screw 5 which passes through the back wall of the housing, through an interior bore 6 in the bar 3 and has a threaded end screwed into a threaded bore in the permanent magnet structure 4.

Mounted on the permanent magnet structure 4 is the moving coil 7 of the moving-coil unit. Coil 7 is wound on an aluminum coil carrier structure and is fabricated using cement of high temperature resistance and of high thermal conductivity, so that the heat generated within coil 7 will be readily transmitted to the permanent magnet structure 4. A spider structure 8 has its outer ends connected to the sound panel 2, to which is also connected the edge suspension 9 for the speaker diaphragm 10. The speaker additionally includes a centering or positioning diaphragm 11 which is connected with the permanent magnet structure 4 by means of screws 12.

During operation of the moving coil 7, the heat which it generates is mainly transmitted to the central core portions of the permanent magnet structure 4. This results in a heating-up of the entire magnet system. The aluminum bar 3, because its thermal conductivity W is likewise equal to or greater than 40 kcal/m-h-°C., transmits this generated heat very efficiently to the aluminum rear wall of the speaker housing 1, where it is readily dissipated into the ambient air.

Figure 2:
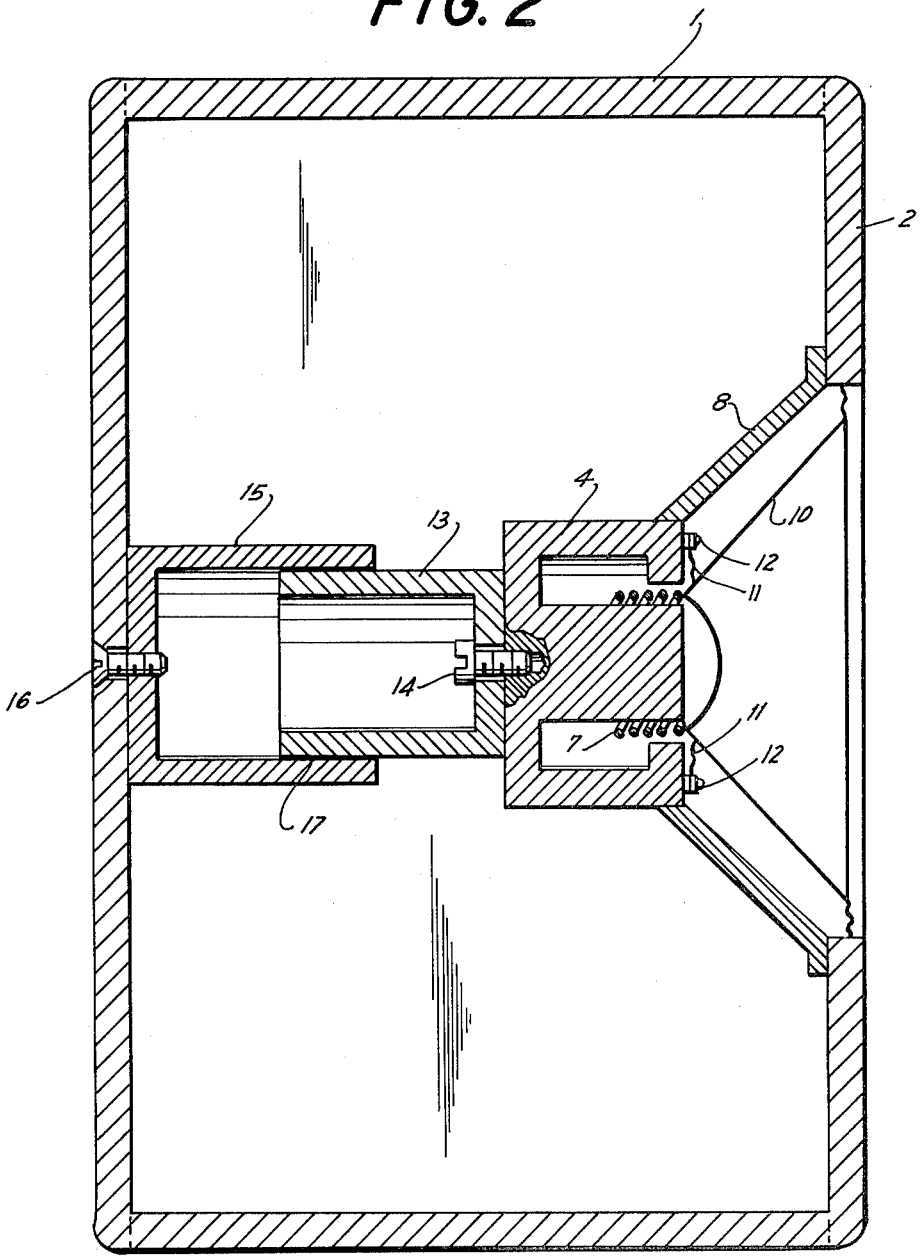
Figure 3:
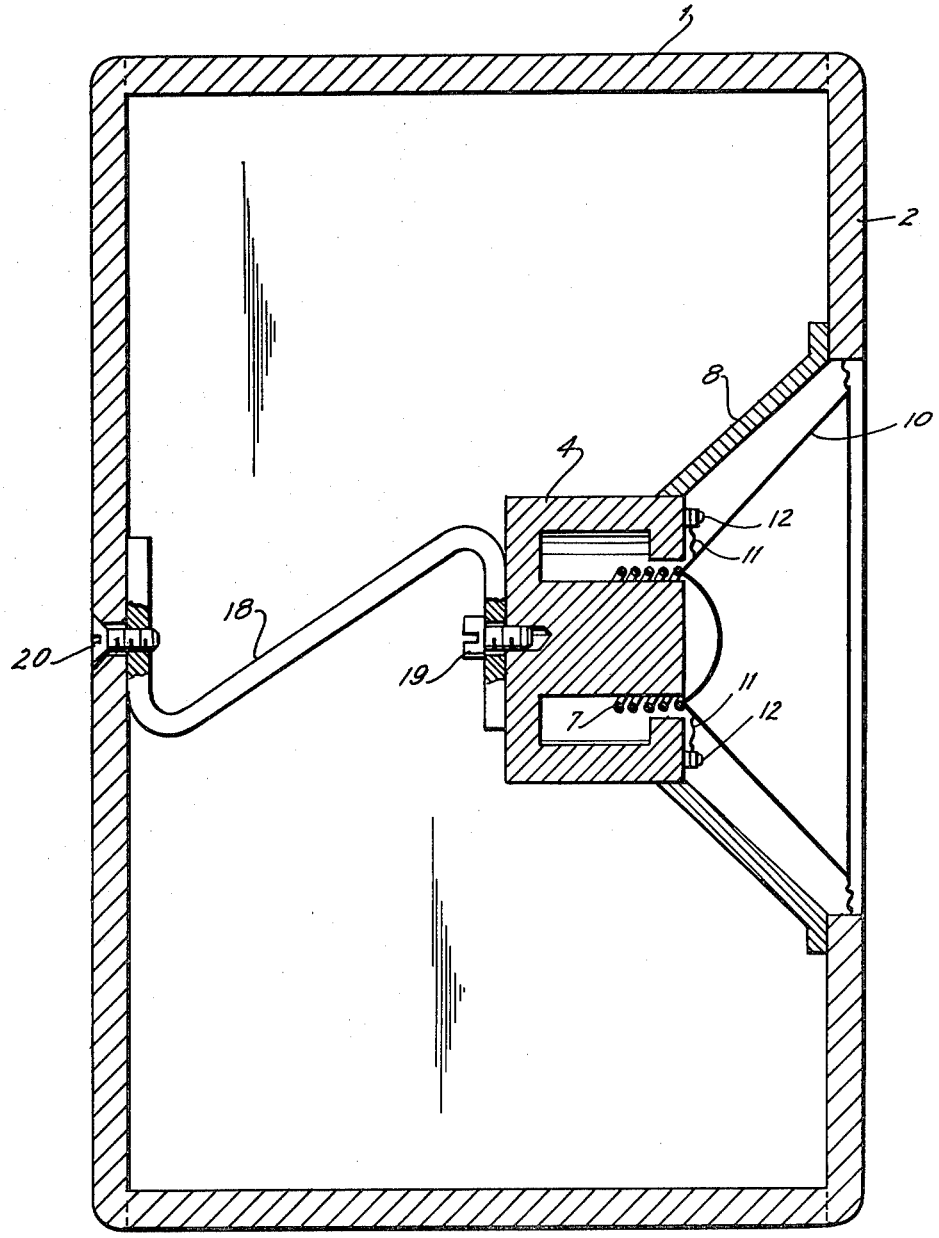

In the embodiment of FIG. 2, the one-piece heat-transmitting structure of FIG. 1 is replaced by a two-piece heat-transmitting structure 13, 15 which permits structure is comprised of a sheet-metal strip 18, bent to have an S-shape. Its right end is secured to the permanent magnet structure 4 by means of a screw 19 and is in thermally conductive engagement with the permanent magent structure 4. Its left end is secured to the aluminum back wall of the speaker housing by means of a screw 20 and is in thermally conductive engagement with the aluminum back wall. The embodiment of FIG. 3, compared to that of FIG. 2, does not create manufacturing tolerance problems. It is possible to use resilient heat-transmitting bodies, embodying the concept of FIG. 3, but of different configuration, i.e., not sheet-metal strips.

Figure 4:
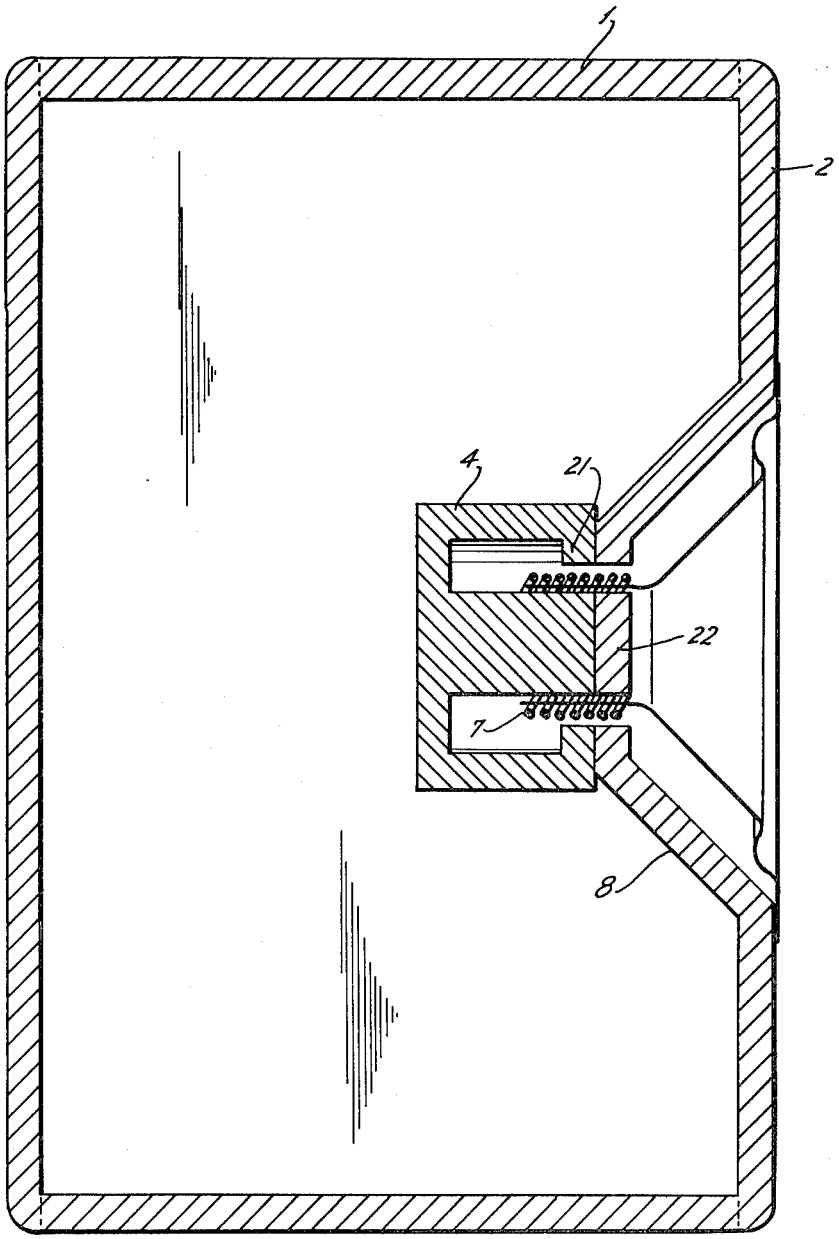
Figure 5:
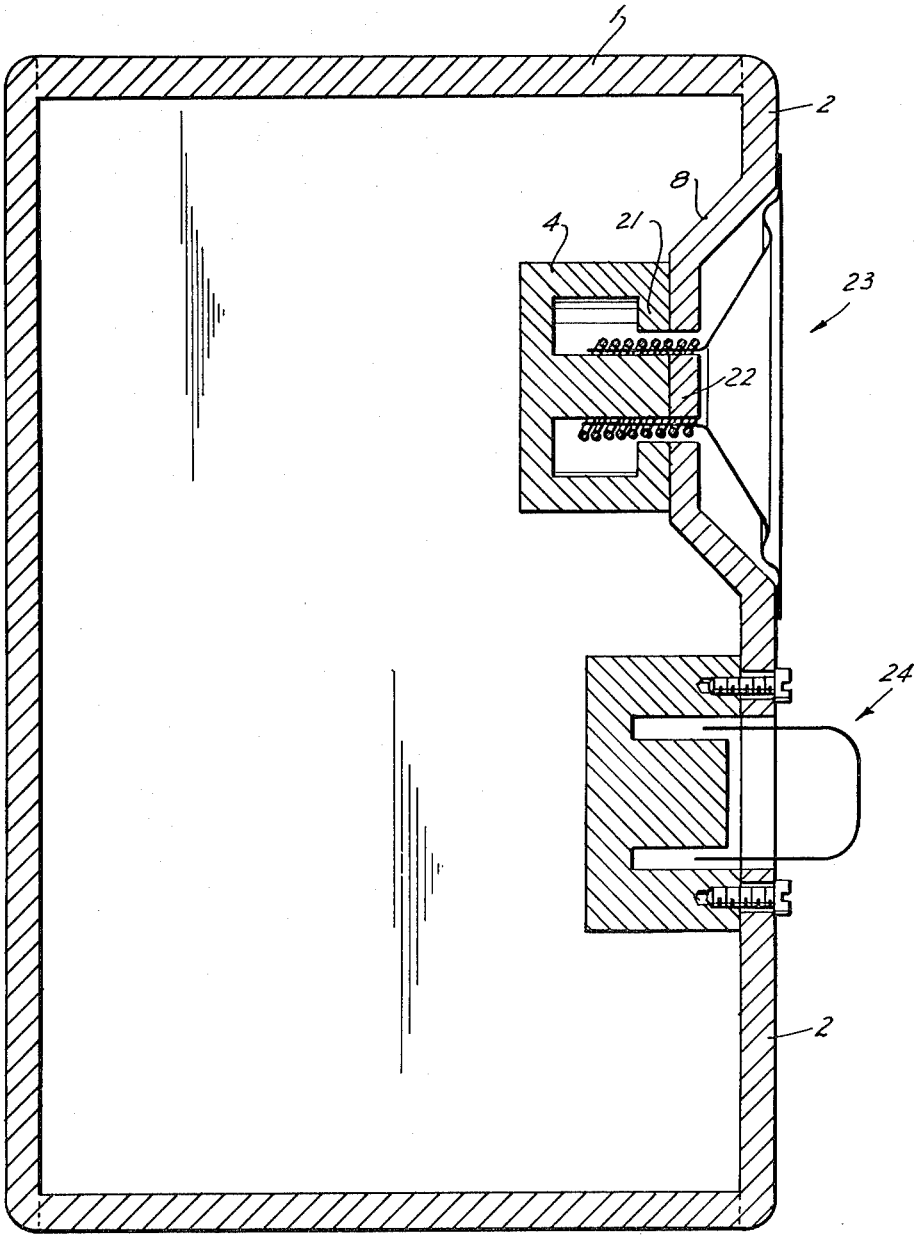

FIG. 4 depicts an embodiment in which the second panel 2 is made of aluminum and the heat generated by the moving-coil unit is transmitted to the sound panel for dissipation into the ambient air. In this embodiment, the spider structure 8 of the speaker is of one piece with the sound panel 2, and accordingly transmits thereto, quite directly, the heat being generated in moving coil 7, to some extent also through the intermediary of the outer pole plate part 21 of the permanent magnet structure. The integration of the sound panel 2 and the spider structure 8 has the additional advantage that the total number of speaker parts is reduced.

For reasons well known in the art, the axial length of the moving coil 7 exceeds the thickness of the pole plate section 21 of the permanent magnet structure 4. The inner end of the spider structure 8 is provided with an opening whose diameter corresponds to that of the annular gap in the permanent magnet structure in which the moving coil 7 is mounted. Here the diameter of the opening in the center of the spider structure 8 is equal to the outer diameter of the annular gap in the permanent magnet structure 4, and is carefully assembled to be in exact register therewith. The central core portion of the permanent magnet structure 4 is provided with an extension 22 having a thickness equal to that of the inner part of the spider structure 8. The inner part of the spider structure 8 has a thickness comparable to that of the pole plate section 21 and forms a structural continuthe sound panel 2 is of one piece with the spider structure and/or with the housing, in all embodiments. Also, whereas in FIGS. 1–5 a speaker of rectangular geometry, having a planar sound panel 2 at its front is shown, the invention is equally applicable to speakers of non-rectangular geometry, having non-planar sound walls 2. In general, the inventive concept is applicable to dynamic speakers of any design, wherever the problem of heat dissipation is encountered. The heat generated by the moving coil of the moving-coil unit can be transmitted to the ambient air via a heat-transmitting structure provided in addition to the anyway present structural parts of the speaker, or the anyway present parts of the speaker can be made of such materials and designed for thermally conductive engagement with one another, to effect the desired heat transmission and dissipation without the addition of a distinct heat-transmitting structure.

It will be understood that each of the elements described above, or two or more together, may also find a useful application in other types of constructions differing from the types described above.

While the invention has been illustrated and described as embodied in speakers of particular design, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a dynamic loudspeaker of the type comprising a housing part and a sound wall part, a diaphragm mounted in the speaker, a moving-coil unit mounted in the speaker and including a moving coil coupled to said diaphragm for transmitting oscillatory motion thereto, said housing part having top, bottom, rear and side parts, each of said top, bottom, rear and side parts having no aperture and no valve openings, said top, bottom, rear and side parts of said housing part being seal-tightly connected with one another, at least said rear part of said housing part being made of a metal having a thermal conductivity W equal to or greater than 40 kcal/m-h-°C., said moving-coil unit including a ferromagnetic structure, said ferromagnetic structure including a central core part, an annular part surrounding the central core part and defining therewith an annular air gap, and a base part bridging together said central core part and said annular part at the rear side of said central core part and of said annular part, said heat-transmitting structure comprising a heat-transmitting bar of metal having a thermal conductivity equal to or greater than 40 kcal/m-h-°C., said heat-transmitting bar having a front face bearing against and in thermally conductive engagement with the portion of said base part of said ferromagnetic structure which is located at said central core part of said ferromagnetic structure, said heat-transmitting bar having a rear face bearing against said rear part of said housing part and being in thermally conductive engagement therewith, the surface area of said front face of said heat-transmitting bar being approximately equal to the cross-sectional area of said core part of said ferromagnetic structure, whereby said heat-transmitting bar transmits the heat mainly generated in said core part of said ferromagnetic structure to said metal rear part of said housing part.

2. In a dynamic loudspeaker as defined in claim 1, the entirety of said housing part and said sound wall part being made of metal having a thermal conductivity of at least 40 kcal/m-h-°C.

3. In a dynamic loudspeaker as defined in claim 1, the entirety of said housing part and the entirety of said sound wall part being made of a metal having thermal conductivity at least equal to 40 kcal/m-h-°C.

4. In a dynamic loudspeaker as defined in claim 1, said sound wall part furthermore including an aperture; furthermore including an auxiliary speaker unit mounted at said aperture, said auxiliary speaker unit comprising a ferromagnetic structure connected to and in thermally conductive engagement with said sound wall part.

* * * * *